United States Patent [19]

Gellhaus

[11] 4,162,968

[45] Jul. 31, 1979

[54] SCREEN APPARATUS FOR SORTING FRAGMENTED MATERIAL

[75] Inventor: Derald B. Gellhaus, Yankton, S. Dak.

[73] Assignee: Kolberg Manufacturing Corporation, Yankton, S. Dak.

[21] Appl. No.: 887,026

[22] Filed: Mar. 16, 1978

[51] Int. Cl.[2] ..... B07B 1/48

[52] U.S. Cl. ..... 209/400

[58] Field of Search ..... 209/400, 401, 403, 405, 209/408; 140/92.1, 108, 109; 84/307, 298, 314

[56] References Cited

U.S. PATENT DOCUMENTS

| | | | |
|---|---|---|---|
| 810,682 | 1/1906 | Shafer et al. | 209/400 |
| 858,706 | 7/1907 | Cunningham | 209/400 |
| 1,739,701 | 12/1929 | Wilson | 209/400 |
| 3,106,524 | 10/1963 | Wolfe et al. | 209/400 X |

FOREIGN PATENT DOCUMENTS

| | | | |
|---|---|---|---|
| 189985 | 12/1922 | United Kingdom | 209/400 |

*Primary Examiner*—Ralph J. Hill

*Attorney, Agent, or Firm*—Williamson, Bains, Moore & Hansen

[57] ABSTRACT

An improved sorting apparatus of the harp screen variety utilizes a plurality of elongated, parallel wire spacing strips positioned along a frame and carried on individual beams which are oriented perpendicular to a multiplicity of tensioned wire lengths extending between wire retaining means at opposed ends of the frame. Each spacing strip has a substantially arcuate, convex upper face with a multiplicity of V-cross section wire receiving guideways which are equally spaced therealong to maintain a predetermined distance of separation between the wire lengths. Each guideway has an arcuate floor which has a convex arch configuration which supports the wire length at the apex of the arch and then drops downwardly to thereby minimize destructive abrasion between wire and guideway floor. The guideway construction tends to reduce wear of the guideway in lateral directions and to utilize normal wear to more firmly seat the wire in the guideway and retain desired spacing between adjacent wires. An improved retaining means is also provided to retain and permit easy tensioning of the wire length.

4 Claims, 8 Drawing Figures

SCREEN APPARATUS FOR SORTING FRAGMENTED MATERIAL

BACKGROUND OF THE INVENTION

The present invention relates to the field of harp screens and provides solutions to a number of long recognized but unsolved shortcomings associated with harp screens.

Harp screens have long been known to the art and recognized as efficient devices for separating and classifying fragmented material. Typically, such harp screens have a rectangular screen box frame and utilize a plurality of individually mounted and tensioned wires which extend longitudinally between the ends of the frame. Generally a plurality of transverse beams extend across the screen box frame, and grooves are cut into the beams so as to receive the longitudinal wires and maintain a predetermined distance of separation between the wires. Commonly, each wire is fixed to the ends of the screen box frame and tensioned by a screw device similar to that used for the tensioning of piano wires.

Such harp screens are effective classification devices but are expensive to manufacture and maintain. For example, each of the transverse supporting beams must have a multiplicity of equally spaced grooves to receive the longitudinally wires and such grooves must be individually cut during manufacturing. No matter how much care is used in the selection of the beams, the grooves tned to wear down in constant use and eventually the grooves will no longer adequately contain the wires, which then slip laterally, changing the separation distance between wires and ruining the accuracy of the screen as a sorting device. Once the grooves in the transverse beams have become worn and unreliable, the entire beam must be removed and replaced. Since the beams are welded to the side walls of the frame, such removal and replacement can be time consuming, difficult, and expensive. Aside from the expense and inconvenience of replacing worn beams, the use of beams with such precut spaced apart grooves practically destroys any versatility of the screen box since the spacing of the wires of the screen cannot be varied once the cuts have been made, and hence the coarseness of the screen is determined with finality.

There have been attempts to reduce the effort needed to replace worn beams, and one of the more popular solutions has been to substitute threaded, hollow rods or pipes for the transverse beams with the individual thread cuts service as grooves in which to contain the longitudinal wires. While this arrangement provides fairly satisfactory initial spacing between wires, the thread cuts are inherently weak at their peaks and in the heavy wear situations encountered by harp screens, the threads wear down rapidly and fail. Soon screen wires start slipping from their initial thread slot positions, move to adjacent slots, are captured in the adjacent slots and do not normally return to the initial slot. The result is that the shortened wear life of threaded rods leads to irregular wire spacing and inacceptable inaccuracies in sorting of fragmented material.

Still another shortcoming of the use of threaded rods or pipes is that the spacing of wires is limited to the pitch of the thread rods or to multiples thereof. In addition, in order to align the adjacent wires passing over successive threaded rods so as to obtain a straight line path for each wire, the rods must commonly be rotated and manipulated so as to properly align the threads. Such manipulation and rotation is difficult and time consuming and must be carefully done before the threaded rods are welded or fixed to the side walls of the screen box. Even after alignment is achieved, the positioning of the wires in the thread cuts is time consuming and slow because the workman must position the yet untightened wires and count the number of thread cuts between adjacent wires so as to obtain the desired spacing, and it has been found that spacing errors are hard to avoid when all thread cuts are not used and all wires are not at final levels of tension.

Finally, the threaded rods are seldom formed of solid material throughout, and normally the rods must be hollow in order to avoid adding so much additional weight and mass to the screen box that the shaking of the screen box becomes overly difficult. Aside from the weight problem, a solid rod would be preferred because it is more likely to be relatively straight and regular in its diameter. It has been found that hollow threaded rods are seldom perfectly straight nor are they constant in their diameter and these irregularities can effect wire spacing and screen accuracy. Additionally, the hollow rods tend to vibrate more than solid rods and this can lead to dislodgement of the wires with resulting changes in spacing, higher wear, and reduced accuracy.

Another shortcoming associated with the use of threaded rods or pipes is that the thread cuts are nonparallel to the wires which define the screen. This nonparallelism results in an almost saw-like action between each thread cut and wire during vibration and this increased friction reduces the use life of both the threaded rods and the wires.

With all known harp screen constructions, the tensioning and retensioning of individual wires is extremely time consuming and slow because the tensioning devices now used on such screens do not adapt readily to conventional torque wrenches.

Accordingly, it is desirable that all the described shortcomings be reduced or alleviated in order that harp screens require less labor to manufacture and maintain, that the desired spacing of wires can be retained for longer intervals and that repair or downtime be reduced. The present invention provides a workable and commercially feasible solution to these long recognized but unsolved problems.

SUMMARY OF THE INVENTION

The invention comprises a screen apparatus of the harp screen type which retains the advantages of the classic harp screen while alleviating many of its shortcomings.

The invention utilizes a rectangular screen box frame having a plurality of rigid, spaced apart, transverse beams which are rigidly fixed to the longitudinal side walls of the frame and each of which receives and supports an elongated easily replacable wire spacing member. Each wire spacing member is preferably a solid steel strip having an arcuate, convex obverse face and a flat reverse side which provides a mounting surface which may be bolted to the transverse upper surface of a beam. The obverse face of each wire spacing member has a multiplicity of spaced-apart, generally parallel guideways for receiving and retaining individual wire lengths. Such spacing members or strips can be prepared with the guideways spaced to the precise requirements of a known classification task and have far greater strength and endurance than the previously used threaded rods. When abrasion does wear down the obverse surface of the strip, such strips are easily removed and inexpensively replaced without need for removal or replacement of the welded transverse beams. While the wire spacing strips are relatively compact for easy shipping and storage, the combination of strip and underlying, rigid transverse beam provides a solid support for the wires of the harp screen and elminates the problem of unwanted vibration occurring with hollow threaded rods or pipes.

Using the described wire spacing members eliminates the described problems associated with most prior art harp screens and provides a longer lasting spacing means which can be easily replaced when necessary. Should it be necessary to modify an already manufactured screen to produce a different spacing of the longitudinal wires, the spacing strips of such screen frame can be unbolted and removed from the frame and an appropriate set of strips with the desired spacing between guideways substituted without major rebuilding of the screen box frame. Accordingly, the use of such strips can substantially reduce the cost of harp screen manufacture, make the screen box frame readily adaptable to various wire spacings, increase the use life of the screen, reduce time and labor to replace worn spacer strips and retain the wires more reliably to assure higher quality in the classification process.

The individual guideways of each wire spacing member are parallel and are preferably provided with a V-shaped cross section and with an arcuate, generally convex floor along each guideway to thereby minimize abrasive rubbing between wire and strip and to best utilize such rubbing to increase use life of the spacing members.

The invention replaces the traditionally used tensioning devices for such screens with a hex-head bolt and pair of locking nuts threaded thereon which permit the wires to be more easily and precisely tensioned with conventional wrenches.

These and other advantages of the invention will appear from the detailed description and the appended drawings in which corresponding elements carry identical reference numerals in the separate figures.

DESCRIPTION OF THE PREFERRED EMBODIMENTS

Figures 1, 2, 3, 4, 5, 6, 7, 8:
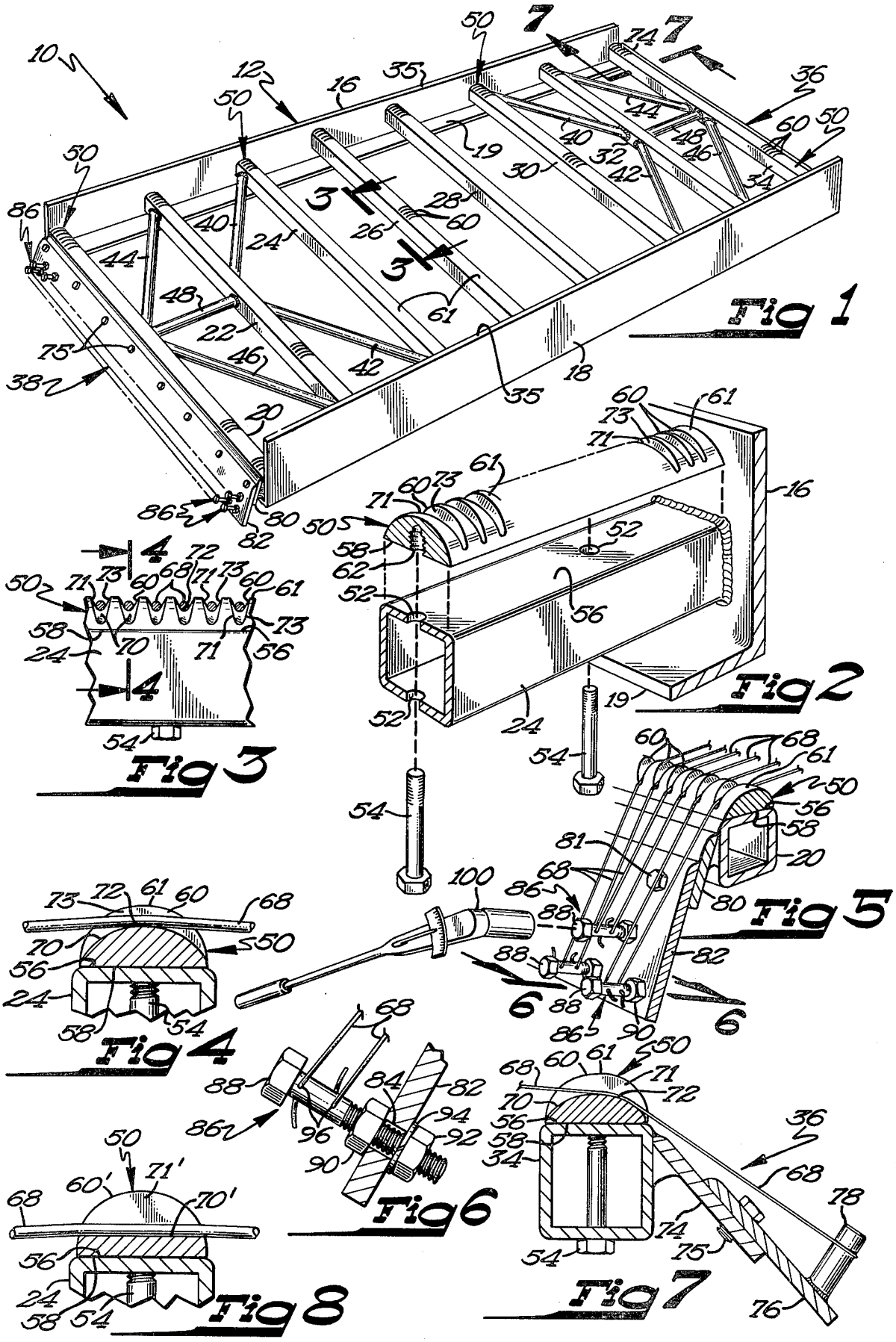
FIG. 1 is a perspective view of a screen box utilizing an embodiment of the invention.
FIG. 2 is a sectional, partial view of a wire spacing member and transverse beam embodying the invention of FIG. 1.
FIG. 3 is a partial front elevation view of a wire spacing member and beam embodying the invention and taken in the direction of arrows 3—3 of FIG. 1.
FIG. 4 is a cross sectional side elevation view taken in the direction of arrows 4—4 of FIG. 3.
FIG. 5 is a perspective partial view of the screen box of FIG. 1 showing an embodiment of the improved retaining means used with the invention.
FIG. 6 is a cross sectional side view taken in the direction of arrows 6—6 of FIG. 5 and further illustrating the retaining means.
FIG. 7 is a cross sectional side view taken in the direction of arrows 7—7 of FIG. 1 and showing the manner in which longitudinal wires are retained at an end of the screen box frame.
FIG. 8 is a cross sectional side elevation view of an alternative embodiment of a wire spacing member utilizing the invention.

Referring now to FIG. 1, an improved screen apparatus 10 has a substantially rigid, rectangular screen box frame 12 which has first and second generally parallel spaced apart, rigid elongated side walls 16 and 18, respectively, formed of steel channel material with webs 19 confronting and extending toward one another. The frame 12 also includes a plurality of generally rigid parallel, spaced apart, transverse beams 20, 22, 24, 26, 28, 30, 32 and 34, each of which has its ends rigidly fixed to side walls 16 and 18 by welding or other means known to the art. The distance between the upper face 56 of each beam and the edge 35 of the side walls decreases at the center of the box with the beams 20–34 defining an arch above which the wire lengths 68 are stretched as is well known to the art.

Each of the beams 20–34 is formed of a relatively rigid, tubular, square cross section steel stock as best seen by beam 24 of FIG. 2. It has been found highly desirable to form the beams of the shown square cross section material so as to provide a rigid foundation with a mounting surface 56 on which wire spacing members or strips can be securely mounted as will be described further hereafter. The transverse beams 20–34 collectively comprise a support means fixed to and extending between the side walls of the frame to strengthen the frame and to support the wire-spacing members which will be described hereafter.

Referring again to FIG. 1, adjacent the first and second ends 36 and 38, respectively of the frame 12, steel reinforcing bars 40 and 42 extend angularly between beams 22 and 24 and also between beams 30 and 32. Similarly, additional reinforcing bars 44, 46 and 48 extend between beams 20 and 22 and also between beams 32 and 34. Accordingly, the side walls 16 and 18, the beams 20–34 and the bars 40–48 collectively comprise a screen box frame usable with the invention.

Since each of the transverse beams 20–34 and its associated wire spacing member or strip 50 are identical to the remaining beams and strips, only the construction of a single beam and strip will be described in detail.

Referring now to FIG. 2, each of the transverse beams such as beam 24, is rigidly fixed to the adjacent side walls 16 and 18 in any known manner, welding being preferred. The beam 24 is formed of commercially available rigid, square cross section, steel stock and provides a sturdy, vibration resistant foundation having an upper mounting surface 56 to which a wire spacing member 50 may be firmly but removably attached. Holes 52 are bored through upper and lower sides of the beams 24 at regular intervals therealong and bolts 54 are passed upwardly through the holes 52 and threaded into the member 50 as will be described further hereafter.

Referring now to FIGS. 1–4, each beam is provided with an elongated, wire spacing member, or strip 50, and each such strip has a generally flat lower mounting surface 58 on the reverse side of the strip which confronts and contacts upper face 56 of a beam, such as beam 24. Each strip 50 is manufactured from half round steel stock and is provided with a multiplicity of generally mutually parallel guideways 60 equally spaced from one another along the arcuate generally convex, obverse side or face 61 at a predetermined distance of separation and also oriented generally parallel to the longitudinal side walls 16 and 18. Naturally, the spacing between adjacent guideways of all the strips is substantially identical and the corresponding guideways of adjacent strips are longitudinally aligned so that wire lengths extending along corresponding guideways define a series of straight line paths extending between the ends of the frame.

Referring now to FIGS. 3 and 4, each guideway 60 has a substantially V-shaped cross section when viewed from the direction of arrows 3—3 of FIG. 1 as best shown in FIG. 3 wherein the V is defined by converging lateral surfaces 71 and 73, the V-shaped cross section making it possible for the guideway to receive and center longitudinal wires 68 of various diameters. The multiplicity of wires 68 are mutually parallel to one another and to the sidewalls 16 and 18.

Each of the guideways 60 is provided with a generally arcuate, convexly arched floor 70 which is located along the intersection of lateral surfaces 71 and 73 of each guideway. The floor 70 has a finite width which is adequate to support some wire diameters used with the screen frame, and the floors of all the guideways of a given strip 50 are substantially perpendicular to the longitudinal axis of the strip 50 and parallel to the wires 68 and the adjacent guideway floors.

The arcuate floor 70 intersects the arcuate outer periphery of strip 50 and the place of intersection is preferably spaced downwardly from the path of the wire length 68 to substantially eliminate rubbing between the wire and the intersection.

An arcuate convex floor 70 has been found helpful for each guideway because it results in a small substantially smooth, surface region 72 of the guideway contacting the wire 68, as best seen in FIG. 4, thereby reducing wear between wire 68 and guideway. As the wire 68 and guideway abrade against one another during normal use, vibration of the wire 68 tends to produce most wear against the area 72 of the floor thereby resulting in the wire 68 seating itself even more deeply and firmly in the guideway. Because the area 72 is shaped to be somewhat more susceptible to wear than the lateral surface 71 and 73, the surface 72 tends to wear slightly faster thereby resulting in the wire 68 dropping downwardly to follow the surface of the floor 70. Such downward movement of the wire 68 does not adversely affect the distance of separation between adjacent wires. In contrast lateral wear and resulting movement of the wire 68 toward the surfaces 71 or 73 would alter the distance of separation between wires and make the sorting apparatus less accurate. As with all harp screens, the wires 68 of the screen 10 need to be periodically retentioned in normal use.

Each of the strips 50 is provided with a plurality of equally spaced threaded bores 62 which enter the reverse surface 61 and communicate with the holes 52 so as to threadably receive bolts 54 to rigidly but removably retain the strip 50 against the upper surface 56 of the beam. This combination of replaceable, solid strip and rigid beam cooperates to define a substantially rigid foundation which resists excessive vibration while still making it possible to easily eliminate worn guideways or to alter the spacing between adjacent guideways when different screen requirements are needed by simply replacing the strips.

Referring now to FIG. 7, first end beam 34 adjacent first end 36 has a bracket 74 fixed thereto by welding and extending along beam 34. A rigid steel mounting plate 76 is fixed to the bracket 74 by bolts 75 and extends downwardly and outwardly from the beam 34. The mounting plate 76 is provided with a plurality of protruding peg type retainers 78 about which a wire may be looped, the free ends of the wire lengths 68 extending toward and being retained at the second end 38 of the screen box. It should be understood that the term wire length, as used herein, refers to a length of wire extending from one end to the remaining end of the screen frame and that with the shown screen, each continuous wire is looped about a peg 78 and is made up of a pair of wire lengths.

Referring now to FIGS. 5 and 6, second end beam 20 extends between side walls 16 and 18 and carries a bracket 80 which is rigidly fixed to beam 20 and supports a generally rectangular, rigid steel mounting plate 82 which extends substantially the width of the screen box 10 and is angled downwardly and outwardly from the beam 20. The plate 82 is fixed to the bracket 80 by bolts 81.

The mounting plate 82 has a multiplicity of apertures 84 passing therethrough, the number of apertures being substantially equal to the number of pairs of wire lengths 68 comprising the screen. A commercially available bolt 86, preferably having a hex head 88, passes through each of the apertures 84 and is secured to the mounting plate 82 by nuts 90 and 92 above and below, respectively, the plate 82. Preferably, a locking washer 94 is interposed between plate 82 and one of the nuts. The shank of each bolt 86 has a pair of transverse bores 96 through which the wire lengths are inserted. The bolts 86 are rotated about their axes and tightened on the plate 82 so that the wire 68 is twisted about the bolt 86 to the desired tension using a torque wrench on the hex head 88, after which, the nuts 90 and 92 are securely tightened to retain the appropriate degree of tension. Accordingly, the screen is comprised of a plurality of wires with each length of wire originating at a bolt 86, extending longitudinally along the screen box frame along a straight line path passing through corresponding, aligned guideways of strips 50, thence to and around a peg retainer 78 and then back to the bolt 86, the wire lengths making up the wire being positioned and aligned in adjacent guideways of the strips 50.

Accordingly, the mounting plates 76 and 82 and the retainers 78 and bolts 86 along with appropriate mounting hardware such as the nuts 90, 92, and lock washer 94 collectively comprise wire retention means adjacent the first and second ends of the frame to retain a multiplicity of wire lengths.

Referring now to FIG. 8, a second embodiment of a guideway utilizing the invention is shown. In the strip 50 of FIG. 8, the guideway 60′ which is one of a multiplicity of adjacent guideways, has a substantially V-shaped cross section and the floor 70′ is level and parallel to both the path of the wire lengths and the reverse surface 58 of strip 50. Like the strips of FIGS. 1–7, the strip of FIG. 8 is removably attached to a transverse beam by bolts 54. A wire length 68 is confined in the guideway to obtain the desired spacing between adjacent wire lengths.

In operation, after the screen box frame 10 has been constructed and the transverse beams 20–34 rigidly fixed to the side walls 16 and 18, an elongated wire spacing member or strip 50 is mounted to the upper surface 56 of each transverse beam with the reverse flat surface 58 of the strip confronting and contacting the mounting surface 56. The particular strip 50 selected for the screen box frame will have a multiplicity of parallel guideways 60 or 60′ therealong, the spacing between adjacent guideways being equal and being selected to meet the specific classification requirement of the screen. The strips 50 are removably bolted into position on top of each transverse beam and the multiplicity of wire lengths 68 are then installed. Each wire is selected with a length adequate to be approximately twice the length of the screen box frame with the midpoint of the wire being looped about a peg retainer 78 at the first end 36 of the screen. The free ends of the wire are then routed to the second end 38 of the screen and passed through the transverse bores 96 of a bolt 86. The wire lengths 68 are aligned in adjacent guideways 60 or 60′ such that each wire length 68 follows a straight line through corresponding guideways of successive strips 20–34 from end beam 34 to end beam 20. The bolt 86 is then tightened by means of a torque wrench 100 or other means known to the art to obtain an appropriate level of tension of the wire lengths 68 and then the nuts 90 and 92 are securely tightened on the mounting plate 82 and lock washer 94 so as to retain the bolt 86 in its predetermined tensioned position. In identical fashion, the remaining wire lengths are attached to the screen frame and tensioned.

As fragmented material is dropped onto the screen 10 and the screen is vibrated during normal usage, the wires 68 have some tendency to stretch and wear, thus requiring periodic tightening of the bolts 68 to maintain the desired degree of tension.

During normal vibration of the wire lengths 68, the lengths 68 rub and abrade slightly against the guideways 60 or 60′. Because of the convex generally arcuate shape of the floor 70 of guideway 60, most such wear in guideway 60 occurs in area 72 of each guideway 60 causng the wire to work its way downwardly to more firmly seat itself in the guideway since this is the path of least resistance to the wire. This result occurs since the area of contact between each wire 68 and area 72 is less than the area of contact between each wire and either lateral side 64 or 66. Hence, the area 72 wears more rapidly and the wire 68 tends to wear downwardly into the area 72 to more firmly seat itself in strip 50 as the wires are tightened. The wire does not tend to concentrate its wear against surfaces 72 and 74 and accordingly the wire orientation in guideways 60 resists lateral shifting. This results in a screen which retains the desired distance of separation between adjacent wire lengths for a longer time period and produces a more accurate classification process.

At such time as the strip 50 with guideways 60 or 60′ has worn to a degree where replacement is needed, an operator need only loosen the longitudinal wire lengths 68 and then remove bolts 54 from the transverse beams to thereby remove the individual wire spacing members or strips 50 which may then be replaced with unworn strips. Similarly, should a different distance of separation between adjacent wire lengths be needed, the existing strips may be removed and replaced with strips having a different distance of separation between guideways.

Accordingly, the invention provides a greatly improved economical screen apparatus in which transverse beams will no longer need replacement because of worn guideways or grooves. The problems of high wear and lateral slippage of wires associated with threaded rods have been substantially solved through the use of easily manufactured and readily installed wire spacing members whose guideway construction results in a long lasting screen with improved wear characteristics.

While the preferred embodiments of the present invention have been described, it should be understood that various changes, adaptations and modifications may be made therein without departing from the spirit of the invention and the scope of the appended claims.

What is claimed is:

1. A screen apparatus for sorting fragmented material comprising:

a substantially rigid, rectangular screen box frame having first and second ends and including first and second longitudinal side walls and support means fixed to and positioned between said side walls of said frame;

a plurality of elongated, wire spacing members, a said member being removably mounted to said support means, and each said member having a mounting surface confronting and engaging said support means and each said member having an arcuate, generally convex face oriented upwardly and away from said support means;

each of said elongated members having therealong a multiplicity of generally parallel guideways equally spaced from one another at a predetermined distance of separation and aligned parallel to said longitudinal side walls, the said guideways of each said member being longitudinally aligned with corresponding guideways of the remaining said members to define a multiplicity of straight line paths extending between said ends;

wire retention means adjacent said first and second ends of said frame;

a multiplicity of screen wire lengths extending longitudinally over said frame along a multiplicity of said straight line paths between said first and second ends and retained by said wire retention means, each said wire length being confined in a plurality of longitudinally aligned guideways of said elongated members to thereby maintain said predetermined distance of separation between adjacent wire lengths;

each of said elongated members comprising a metal strip having a substantially arcuate outer periphery;

each of said guideways having a substantially V-shaped cross section so as to closely confine a said wire length having any of a predetermined range of diameters;

each said guideway having an arcuate, generally convex floor; and said floor of each said guideway intersecting said outer periphery of each said elongated strip at a location spaced downwardly from said wire length passing through said guideway to thereby substantially eliminate destructive rubbing of the wire length against the intersection of said floor of said guideway and said face.

2. The screen apparatus of claim 1 wherein said plurality of transverse beams includes first and second end beams positioned adjacent said wire retaining means, said retaining means includes first and second rigid mounting plates fixed relative to and angling downwardly and longitudinally away from said first and second beams, respectively, said plurality of strips including first and second end strips mounted to said first and second end beams, respectively, and said intersection between said outer periphery of said end strips and said floor of said guideways of each strip being spaced downwardly from said wire lengths to inhibit destructive rubbing when said wire lengths angle downwardly from said end strips to said downwardly angled rigid mounting plates.

3. A screen apparatus for sorting fragmented material comprising:

a substantially rigid, rectangular screen box frame having first and second ends and including first and second longitudinal side walls and support means fixed to and positioned between said side walls of said frame;

a plurality of elongated, wire spacing members, a said member being removably mounted to said support means, and each said member having a mounting surface confronting and engaging said support means and each said member having an arcuate, generally convex face oriented upwardly and away from said support means;

each of said elongated members having therealong a multiplicity of generally parallel guideways equally spaced from one another at a predetermined distance of separation and aligned parallel to said longitudinal side walls, the said guideways of each said member being longitudinally aligned with corresponding guideways of the remaining said members to define a multiplicity of straight line paths extending between said ends;

wire retention means adjacent said first and second ends of said frame;

a multiplicity of screen wire lengths extending longitudinally over said frame along a multiplicity of said straight line paths between said first and second ends and retained by said wire retention means, each said wire length being confined in a plurality of longitudinally aligned guideways of said elongated members to thereby maintain said predetermined distance of separation between adjacent wire lengths;

each of said elongated members comprising a metal strip having a substantially arcuate outer periphery;

each of said guideways having a substantially V-shaped cross section so as to closely confine a said wire length having any of a predetermined range of diameters;

said support means including a plurality of transverse beams extending between and fixed to said first and second side walls; and each of said members being removably retained to a said beam by bolts passed upwardly through said beam and threaded into said elongated member.

4. A screen apparatus for sorting fragmented material comprising:

a substantially rigid, rectangular screen box frame having first and second ends and including first and second longitudinal side walls and support means fixed to and positioned between said side walls of said frame;

a plurality of elongated, wire spacing members, a said member being removably mounted to said support means, and each said member having a mounting surface confronting and engaging said support means and each said member having an arcuate, generally convex face oriented upwardly and away from said support means;

each of said elongated members having therealong a multiplicity of generally parallel guideways equally spaced from one another at a predetermined distance of separation and aligned parallel to said longitudinal side walls, the said guideways of each said member being longitudinally aligned with corresponding guideways of the remaining said members to define a multiplicity of straight line paths extending between said ends;

wire retention means adjacent said first and second ends of said frame;

a multiplicity of screen wire lengths extending longitudinally over said frame along a multiplicity of said straight line paths between said first and second ends and retained by said wire retention means, each said wire length being confined in a plurality of longitudinally aligned guideways of said elongated members to thereby maintain said predetermined distance of separation between adjacent wire lengths;

each said guideway having a floor and said floor being arcuate and convex and intersecting said arcuate face of each said member to thereby inhibit rubbing between said wire lengths and said guideways;

each said guideway including a pair of spaced apart lateral sides which intersect said floor;

the area of contact between said wire length along said guideway and said floor being less than the area of contact between said wire length and either of said lateral sides of said guideway to thereby encourage vibrational wear against said floor and discourage wear against said lateral sides; and said support means including a plurality of transverse beams and each said beam having a square cross sectional configuration so as to resist excessive independent vibration and define a mounting surface for receiving of said wire spacing members.

* * * * *